US010156116B2

(12) United States Patent
Oag et al.

(10) Patent No.: US 10,156,116 B2
(45) Date of Patent: Dec. 18, 2018

(54) CLOSURE APPARATUS

(71) Applicant: SPEX Engineering (UK) Limited, Aberdeen (GB)

(72) Inventors: James George Oag, Aberdeen (GB); Rae Andrew Younger, Ellon (GB)

(73) Assignee: SPEX CORPORATE HOLDINGS LIMITED (GB)

( * ) Notice: Subject to any disclaimer, the term of this patent is extended or adjusted under 35 U.S.C. 154(b) by 0 days.

(21) Appl. No.: 15/037,136

(22) PCT Filed: Nov. 18, 2014

(86) PCT No.: PCT/GB2014/053400

§ 371 (c)(1),
(2) Date: May 17, 2016

(87) PCT Pub. No.: WO2015/071694

PCT Pub. Date: May 21, 2015

(65) Prior Publication Data

US 2016/0273296 A1 Sep. 22, 2016

(30) Foreign Application Priority Data

Nov. 18, 2013 (GB) ..... 1320357.5

(51) Int. Cl.
*E21B 33/06* (2006.01)
*E21B 33/02* (2006.01)
(Continued)

(52) U.S. Cl.
CPC ..... *E21B 33/06* (2013.01); *E21B 29/02* (2013.01); *E21B 29/08* (2013.01); *E21B 33/061* (2013.01)

(58) Field of Classification Search
USPC ..... 251/1.1, 1.2
See application file for complete search history.

(56) References Cited

U.S. PATENT DOCUMENTS 1,522,239 A 1/1925 Hansen
1,830,214 A 11/1931 Van Keulen
(Continued)

FOREIGN PATENT DOCUMENTS

GB 2093502 A 9/1982
GB 2497089 A 6/2013
(Continued)

OTHER PUBLICATIONS

International Search Report to corresponding Int'l Pat. Appl. No. PCT/GB2014/053400, dated Jul. 21, 2015, 12 pages.
(Continued)

*Primary Examiner* — Marina Tietjen
*Assistant Examiner* — Daphne M Barry
(74) *Attorney, Agent, or Firm* — Tarolli, Sundheim, Covell & Tummino LLP

(57) ABSTRACT

An apparatus for at least partially closing a throughbore is described. The apparatus comprises an apparatus housing, the apparatus housing defining a throughbore and a plurality of closure elements, each closure element being adapted to move between a retracted position, in which the throughbore is fully open, and a deployed position, in which the throughbore is at least partially closed, at least a portion of the movement of each closure element between the retracted position and the deployed position being rotational.

12 Claims, 10 Drawing Sheets

(51) Int. Cl.
*E21B 29/08* (2006.01)
*E21B 29/02* (2006.01)

(56) References Cited

U.S. PATENT DOCUMENTS

| | | | | |
|---|---|---|---|---|
| 1,856,512 | A | 5/1932 | Schofield et al. | |
| 1,858,352 | A | 5/1932 | Young | |
| 1,938,019 | A * | 12/1933 | Hild | E21B 33/06 137/412 |
| 2,313,177 | A | 3/1943 | Sprague | |
| 2,504,377 | A | 4/1950 | Bell | |
| 7,510,002 | B2 * | 3/2009 | Brown | E21B 33/061 166/330 |
| 2006/0102359 | A1 | 5/2006 | Brown et al. | |
| 2013/0199802 | A1 | 8/2013 | Weir et al. | |
| 2017/0130549 | A1 * | 5/2017 | Kroesen | E21B 33/063 |

FOREIGN PATENT DOCUMENTS

| | | | |
|---|---|---|---|
| WO | 2006051317 | A1 | 5/2006 |
| WO | 2006051324 | A1 | 5/2006 |

OTHER PUBLICATIONS

EP Examination Report dated Jan. 3, 2018 for corresponding EP Application No. 14815793.6.

* cited by examiner

CLOSURE APPARATUS

RELATED APPLICATIONS

The present application is a U.S. National Stage under 35 USC 371 patent application, claiming priority to Ser. No. PCT/GB2014/053400, field on Nov. 18, 2014, which claims priority from GB1320357.5, filed on Nov. 18, 2013, both of which are incorporated herein by reference.

FIELD OF THE INVENTION

The present invention relates to an apparatus for at least partially closing a throughbore. Particularly, but not exclusively, in some embodiments the apparatus is adapted to close and/or seal a wellbore and/or systems connected to the wellbore.

BACKGROUND TO THE INVENTION

Blowout preventers (BOP) are used on some wellheads as a method of sealing a wellbore in the event of an emergency situation in oil and gas wells. Within the wellbore, and running through the blowout preventer there is usually some form of a tubular, generally drill pipe, or some form of tool string.

Conventional ram-type blowout preventers consist of a pair of opposed rams located either side of the wellbore in a blowout preventer housing. In the event of an emergency situation, the rams are driven towards each other and either seal against the tubular in the well bore to seal the annulus between the tubular and the wellbore, or sever the tubular or tool string in the wellbore to substantially seal the well. The driving mechanism for the rams is generally hydraulically driven, and a significant hydraulic force is required to propel the rams, particularly if severance is the objective.

Conventional blowout preventers require different rams to perform the sealing operation to those required for the severing operation. Furthermore, in some instances, a pair of conventional blowout preventer rams cannot seal against different diameters of tubular running through the preventer housing. If different diameters of tubular are to be sealed against, rams are provided for each diameter of a tubular.

A further disadvantage of conventional blowout preventers is the size of the housing required to store the rams in normal, non-emergency use. In an emergency situation, the rams move from a storage position, perpendicular to the axis of the wellbore into the wellbore, and, accordingly, a significant amount of space is required either side of the wellbore to accommodate both the rams and the associated drive mechanism.

SUMMARY OF THE INVENTION

According to a first aspect of the present invention there is provided an apparatus for at least partially closing a throughbore, the apparatus comprising:

an apparatus housing, the apparatus housing defining a throughbore; and a plurality of closure elements, each closure element being adapted to move between a retracted position, in which the throughbore is fully open, and a deployed position, in which the throughbore is at least partially closed, at least a portion of the movement of each closure element between the retracted position and the deployed position being rotational.

Providing an apparatus which is adapted to at least partially close the throughbore by at least an element of rotation of the closure elements allows for a relatively compact closure mechanism. This is of particular benefit when the apparatus is used as a blowout preventer as rotational rather than linear movement allows for a smaller device to be used.

Furthermore, using rollers rather than rams has the additional benefit that the pressure in the throughbore does not need to be overcome to at least partially close the throughbore.

For the avoidance of doubt, by a "deployed position" it is meant any position in which a closure element reduces the minimum cross-sectional area of the throughbore before deployment.

In some embodiments, the apparatus may be suitable for at least partially sealing a throughbore.

In some embodiments, the apparatus may close and seal a throughbore.

The apparatus may be a blowout preventer. A blowout preventer is an example of a particular type of apparatus for which there would be transport, installation and operational savings by being a reduced size and/or weight over conventional blowout preventers.

The apparatus may be part of a lightweight riserless intervention system. In such a system, the apparatus can be used to seal sections of a bore, receive tools, for example, lowered down from the surface and seal the tools within the bore.

The apparatus may be adapted to act as a valve, for example a variable choke.

The housing may be adapted to receive a downhole tool in the housing throughbore. By tool that is meant any apparatus which is of use in a downhole environment. This could be a section of drill pipe or tubular as well as a more conventional tools.

The downhole tool may be a substantially tubular, for example drill pipe, casing, production tubing or a well tool.

Alternatively the downhole tool may be non-tubular such as wireline, slickline etc.

The apparatus may be adapted to grip the downhole tool.

Alternatively or additionally, the apparatus may be adapted to seal against the downhole tool.

Alternatively or additionally, the apparatus may be adapted to cut through the downhole tool.

In further alternative or additional embodiments, the apparatus may be adapted to centralise the downhole tool within the throughbore.

At least one of the closure elements may define at least one engagement surface.

At least one of the closure elements may define a surface profile adapted to form a seal with a seal surface.

The surface profile may be defined by the apparatus.

Particularly the surface profile may be defined by at least one other closure element.

Alternatively, the surface profile may be defined by the downhole tool.

In this embodiment the surface profile may comprise metallic, elastomeric or any suitable sealing material.

The apparatus may be adapted to deliver a sealing medium to the surface profile.

The sealing medium may be a fluid such as grease.

In at least one embodiment, the/each closure element may define a first engagement surface.

The first engagement surface may define the surface profile.

When in use with a first downhole tool having a first downhole tool diameter, the closure elements may be adapted, in use, to move from the retracted position to a first deployed position in which the closure elements engage the first downhole tool external surface such that an annulus defined by a throughbore surface and an external first downhole tool surface is closed.

In use, when engaged with the first downhole tool in the first deployed position, the/each closure element first engagement surface may be in contact with the first downhole tool.

In use, when engaged with the first downhole tool, the/each closure element first engagement surface forms a continuous contact surface around the full circumference or perimeter of the external downhole tool surface.

The/each closure elements may, in use, be adapted to form a seal with the first downhole tool surface.

In an embodiment where there are two closure elements, each closure element engages at least 50% of the first downhole tool external circumference or perimeter.

In an alternative embodiment, at least one of the closure elements engages less than 50% of the first downhole tool external circumference or perimeter.

At least one of the closure elements may make a point contact with the first downhole tool. For example the closure element may pierce the downhole tool or apply a point force to the tool.

When in use with a second downhole tool having a second downhole tool diameter, the closure elements may be adapted, in use, to move from the retracted position to a second deployed position in which the closure elements engage the second downhole apparatus external surface such that an annulus is defined by a throughbore surface and an external second downhole apparatus surface.

The/each closure element may define a second engagement surface.

In use, when engaged with the second downhole tool in the second deployed position, the/each closure element second engagement surface may be in contact with the downhole tool.

In use, when engaged with the second downhole tool, the closure element second engagement surfaces form a continuous contact surface around the full circumference of the downhole tool external surface. In an embodiment where there are two closure elements, each closure element engages at least 50% of the downhole tool external surface circumference.

The closure elements may, in use, be adapted to form a seal with the second downhole tool surface.

Providing an apparatus in which closure elements seal against tools of different diameters increases the utility of the apparatus and provides an apparatus which is lighter and easier to operate than conventional closure devices. Where the apparatus is a blowout preventer, the first downhole apparatus may be casing having a diameter, for example, of 13⅝ inches and the second downhole apparatus may be drill pipe having a diameter of 2½ inches.

In one embodiment a continuous downhole tool engaging surface is provided, the continuous downhole tool engaging surface being adapted to seal against any one of a number of tools of different diameters which may be within the throughbore.

In this embodiment, the first engaging surface and the second engaging surface may be different portions of the continuous downhole tool engaging surface.

Alternatively or additionally, each closure element may define multiple engagement surfaces for engaging tubulars of differing diameters.

In some embodiments different engaging surface portions may be adapted to perform different portions, for example gripping and sealing.

Each closure element may define a plurality of rollers.

The rollers may be concentric.

Each engagement surface may be defined by one or more rollers.

In the embodiment, at least one roller may be adapted to rotate independently of at least one other roller.

In this embodiment at least one roller is adapted to rotate in an opposite direction to at least one other roller.

In this and other embodiments adjacent rollers may cooperate to apply a shear force to a downhole tool.

At least one of the closure elements may comprise a plurality of closure element sections.

The sections may be in series.

At least one section may be adapted to rotate independently of at least one other section.

In some embodiments at least one first section may be adapted to perform one function (for example gripping the downhole tool) whilst at least one second section is adapted to perform another function (for example cutting the downhole tool).

At least one closure element may comprise at least one sensor.

In the deployed position the/each closure element may deploy the sensor in the throughbore. The sensor may be a temperature or pressure sensor, or may be adapted to count joints in a length of tubular for example.

The apparatus may comprise severing means adapted to sever an object, such as a tubular, passing through the apparatus. Where the apparatus is a blowout preventer, the object could be drill pipe, wireline, tool strings etc.

The severing means may be attached to, or integral with, the closure elements.

Alternatively or additionally, the severing means may be separate from the closure elements.

Where the closure element defines at least one engagement surface, the severing means may be located on or adjacent to the/each engagement surface.

The severing means may be a blade, teeth, serrations or the like.

Alternatively or additionally, the severing means may be an explosive material.

The severing means may be an energetic or a laser or the like.

In one embodiment the explosive material may be at least one shaped charge.

The at least one shaped charge may be a linear charge.

Alternatively or additionally, the at least one shaped charge may be a plurality of shaped charges.

The closure elements may be adapted to move to a throughbore closed position. In the throughbore closed position the throughbore is shut.

In some embodiments, in the throughbore closed position the throughbore is sealed.

In one embodiment, a pair of closure elements may be adapted to cooperate to close the throughbore. For example each closure element may, in the throughbore closed position, close 50% of the throughbore.

In the throughbore closed position, adjacent closure elements may engage.

In this embodiment, each closure element may define a closure surface portion such that in the throughbore closed position the closure surface portion of one closure element is engaged with the closure surface portions of at least one other closure element.

In the throughbore closed position, adjacent closure elements may be adapted to form a seal therebetween.

There may be a plurality of pairs of closure elements, each closure element pair being adapted to at least partially close the apparatus housing throughbore.

The closure element pairs may be arranged in series along the housing throughbore longitudinal axis.

Adjacent pairs of closure elements may be adapted to cooperate to sever a tubular.

Where there are multiple pairs of closure elements, one pair may be adapted to engage a downhole apparatus to seal an annulus, and another pair may be adapted to sever the tubular.

Once engaged with the tubular, each pair of closure elements may be adapted to rotate around a throughbore longitudinal axis. Such an arrangement allows for pressure to be applied in a radial direction towards the centre of the throughbore and tangentially to a radius of the throughbore.

Adjacent pairs of closure elements may be adapted to rotate in opposite directions. Such an arrangement can create a shearing force to rip a tubular.

Each closure element may rotate about a closure element axis.

Each closure element may be substantially cylindrical.

The closure elements may be of different diameters.

The closure elements may have non-cylindrical cross sections.

In some embodiments there may be tear shaped, oval or include some camming surfaces. Closure elements having non-cylindrical cross sections can be used to induce lateral movement as well as rotation movement.

The closure elements may move between the retracted position and a deployed position by rotation only.

In other embodiments the closure elements may move between the retracted position and a deployed position by means of rotation and lateral movement.

The lateral movement may be substantially perpendicular to an apparatus throughbore longitudinal axis.

The lateral movement may be created by a camming effect.

Alternatively or additionally, the lateral movement may be created by a pressure in the throughbore. Particularly, where the apparatus is adapted to seal against a downhole apparatus in a wellbore or adjacent closure elements are adapted to seal against each other to fully close a wellbore, well pressure may be utilised to improve the seal.

In alternative or additional embodiments the closure elements may be adapted to move laterally in the deployed position.

In these embodiments the closure elements may move parallel to the axis of the bore or across the bore.

The closure elements may move laterally in the same or opposite directions.

The closure elements may be biased to a deployed position.

The closure elements may be held in the retracted position against the biasing force.

The closure elements may be held in a retracted position by a counter force.

The counter force may be applied by, for example, a nitrogen charge or a mechanical actuator. In alternative embodiments the counter force may be applied by, for example electric power or hydraulic power. In the event of a failure of the counter force the apparatus can be made fail safe and the closure elements move to a deployed position.

The closure elements may be biased by means of a spring or the like to a deployed position.

Where there are two closure elements, the closure elements may be adapted to rotate in opposite directions.

Alternatively, or additionally, the closure elements may be adapted to rotate in the same direction.

The apparatus may further comprise an activator.

The activator may be adapted to move the closure elements from the retracted position to the deployed position.

The activator may be adapted to move the closure elements from the retracted position to one of said deployed positions upon receipt of an initiation signal.

The initiation signal may be received from, for example, sensors in the throughbore.

Alternatively or additionally, the initiation signal may be received from a remote location.

The initiation signal may be a manually issued signal or alternatively the initiation signal may be an automatic signal.

The activator may be adapted to apply a force to the closure elements.

The force may be applied instantaneously. A flywheel and a clutch may be used to transfer the force generated by the rotation of the flywheel to the closure elements.

Each closure element may be moveable with respect to the apparatus housing.

According to a second aspect of the present invention there is provided an apparatus for severing the tubular, the apparatus comprising:

an apparatus housing, the apparatus housing defining a throughbore, the throughbore being adapted to receive a tubular;

a severing device adapted to sever a downhole apparatus located, in use, in the apparatus housing throughbore, the severing device being adapted to be moved from a retracted position to the severing position, wherein at least a portion of the movement of the/each severing device from the retracted position to the deployed position is rotational.

In at least one embodiment, the severing device is an explosive material.

According to a third aspect of the present invention there is provided a blowout preventer, the blowout preventer comprising:

an apparatus housing, the apparatus housing defining a throughbore; and a plurality of closure elements, each closure element being adapted to move between a retracted position, in which the throughbore is fully open, and a deployed position, in which the throughbore is at least partially closed, at least a portion of the movement of each closure element between the retracted position and the deployed position being rotational.

According to a fourth aspect of the present invention there is provided an apparatus for moving a downhole tool through a throughbore, the apparatus comprising:

an apparatus housing, the apparatus housing defining a throughbore; and a plurality of operational elements, each operational element being adapted to engage a downhole tool, the downhole tool located in the throughbore, rotational movement of the operational elements causing axial movement of the downhole tool.

BRIEF DESCRIPTION OF THE DRAWINGS

Embodiments of the present invention will now be described with reference to the accompanying Figures in which.

DETAILED DESCRIPTION OF THE DRAWINGS

Figure 1:
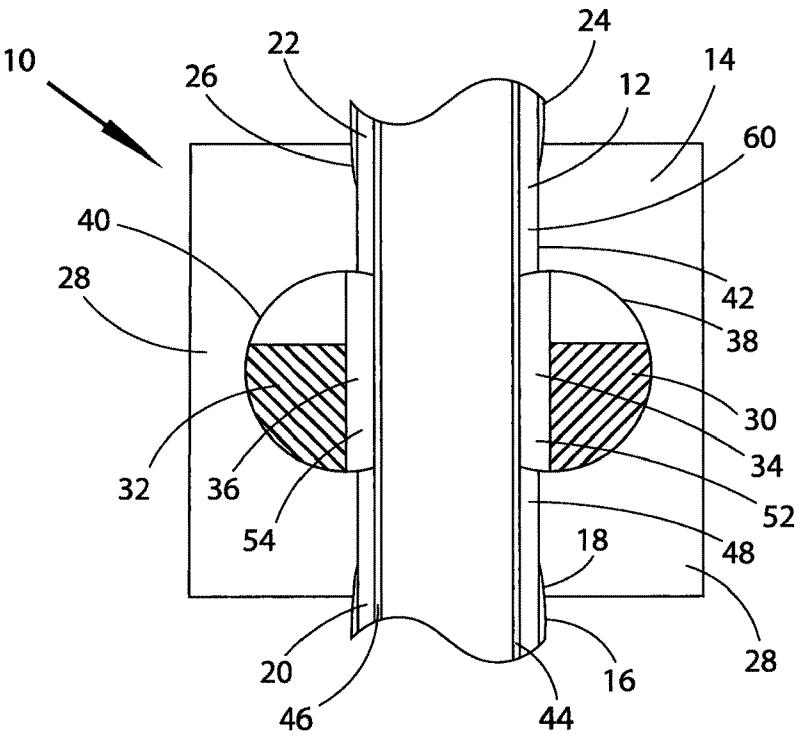
FIG. 1 is a section of an apparatus for at least partially closing a throughbore, shown in the throughbore open position, according to a first embodiment of the present invention.

Reference is first made to FIG. 1, a section of an apparatus, generally indicated by reference numeral 10, for at least partially closing a throughbore 12, shown in the throughbore open position, according to a first embodiment of the present invention.

The apparatus 10 is a blowout preventer 14 mounted to a wellhead 16, a lower end 20 of the blowout preventer throughbore 12 being in fluid communication with, and connected to, the wellhead 16 by a mechanical connection such as a threaded connection 18 and an upper end 22 of the blowout preventer throughbore 12 being in fluid communication with, and connected to a riser 24 by a second threaded connection 26.

The blowout preventer 14 comprises a blowout preventer housing 28, the housing 28 defining the throughbore 12. The throughbore 12 defines a surface 42 and is adapted to receive a downhole apparatus 44 in the form of drill pipe 46 having an external surface 48. The throughbore surface 42 and the drill pipe external surface 48 define a well annulus 60.

The blowout preventer 14 further comprises a first closure element 30 and a second closure element 32. The closure elements 30, 32 are cylindrical and are adapted to rotate about first and second rotation axes 34, 36 respectively. The closure elements 30, 32 rotate about the first and second rotation axes 34, 36 between a retracted position (shown in FIG. 1) in which the throughbore 12 is fully open, and a deployed position, which will be discussed in due course.

The cylindrical closure elements 30, 32 extend through the housing 28 in first and second pockets 38, 40, defined by the housing 28, respectively.

The first closure element 30 defines a semi-circular throughbore aperture 52 having a diameter slightly larger than the diameter of the throughbore 12.

Figure 2:
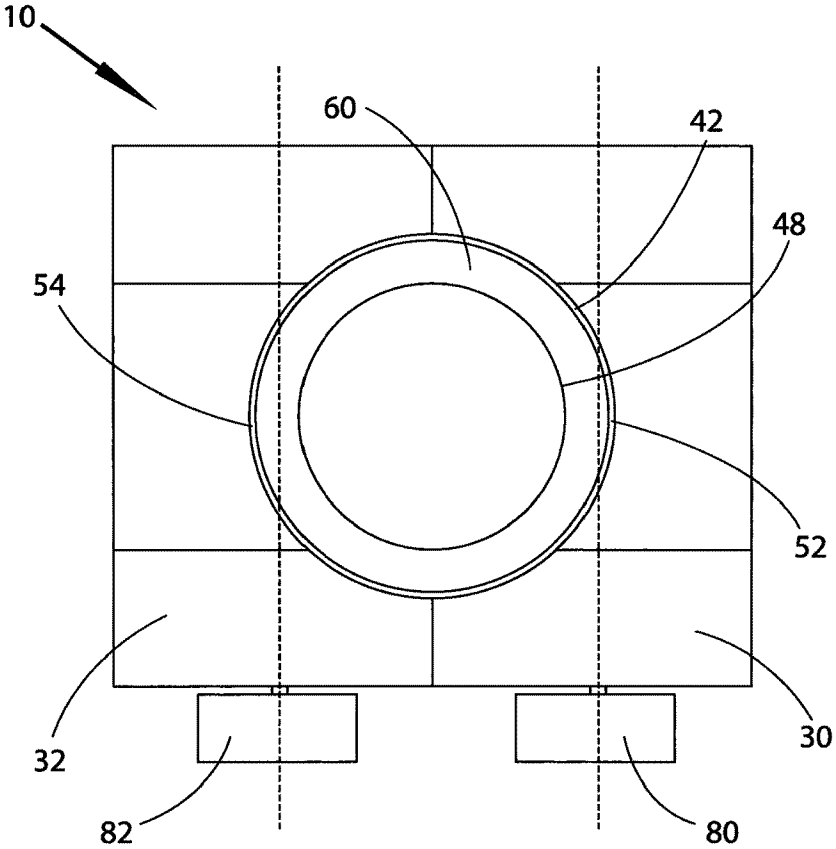
FIG. 2 is a plan view of the first and second closure elements of the apparatus of FIG. 1 shown in the throughbore open position.

This aperture 52 is best seen in FIG. 2, a plan view of the first and second closure elements 30,32 of the apparatus of FIG. 1 shown in the throughbore open position, the throughbore internal surface 42 and the downhole apparatus external surface 48 being shown for context only and defining the annulus 60. The second closure element also defines a semi circular throughbore aperture 54, the closure elements 30, 32 cooperating such that the first closure element throughbore aperture 52 and the second closure element throughbore aperture 54 encircle but do not encroach on the throughbore 12.

FIG. 2 also shows a first and second drive motor 80,82 located adjacent each closure element 30,32 for rotating the closure elements around the rotation axes 34,36.

Figure 3:
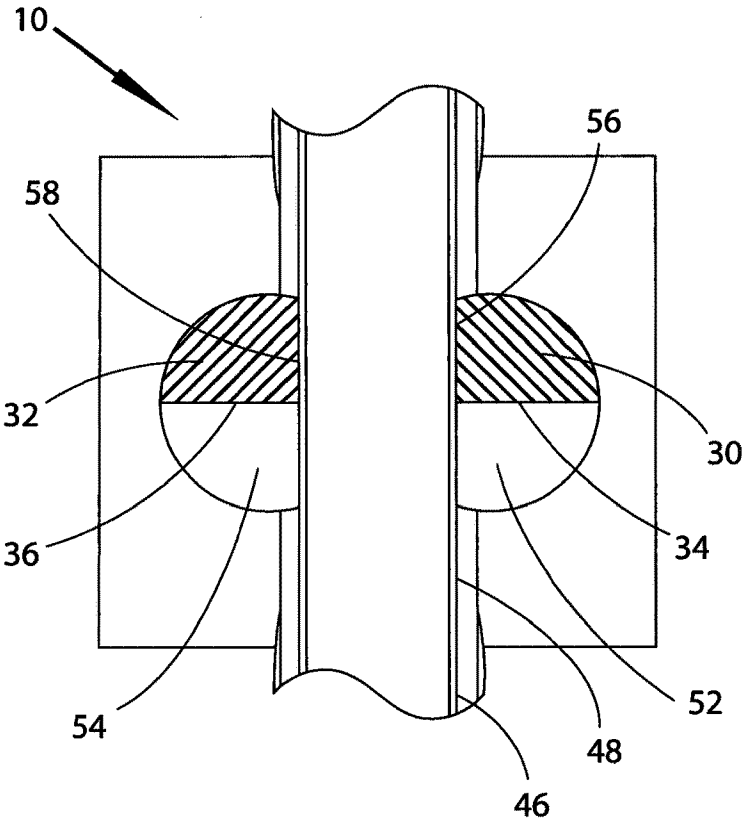
FIG. 3 is a section of the apparatus of FIG. 1 shown in an annulus closed position.

Referring now to FIG. 3, a section of the apparatus 10 of FIG. 1 shown in an annulus closed position, it will be noted that the first and second closure elements 30, 32 have been rotated about their respective rotation axes 34, 36 such that respective first engagement surfaces 56, 58 have come into a sealing engagement with the drill pipe external surface 48.

Figure 4:
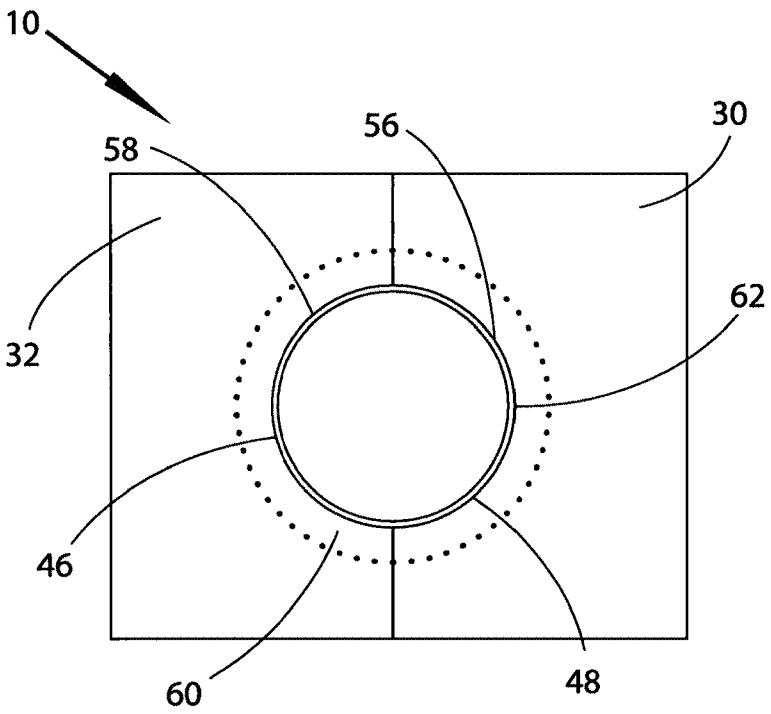
FIG. 4 is a plan view of the first and second closure elements of the apparatus of FIG. 1 shown in the annulus closed position.

Referring to FIG. 4, a plan view of the first and second closure elements 30, 32 of the apparatus 10 of FIG. 1 shown in the annulus closed position, the first engagement surfaces 56, 58, cooperate to form a continuous seal 62 against the drill pipe external surface 48 thereby sealing the annulus 60.

The engagement surfaces 56, 58 are semi circular engagement apertures having a diameter substantially the same as the external diameter of the drill pipe 46. As can be seen from FIG. 3, the engagement surfaces 56, 58 are perpendicular to the throughbore apertures 52, 54.

Figure 5:
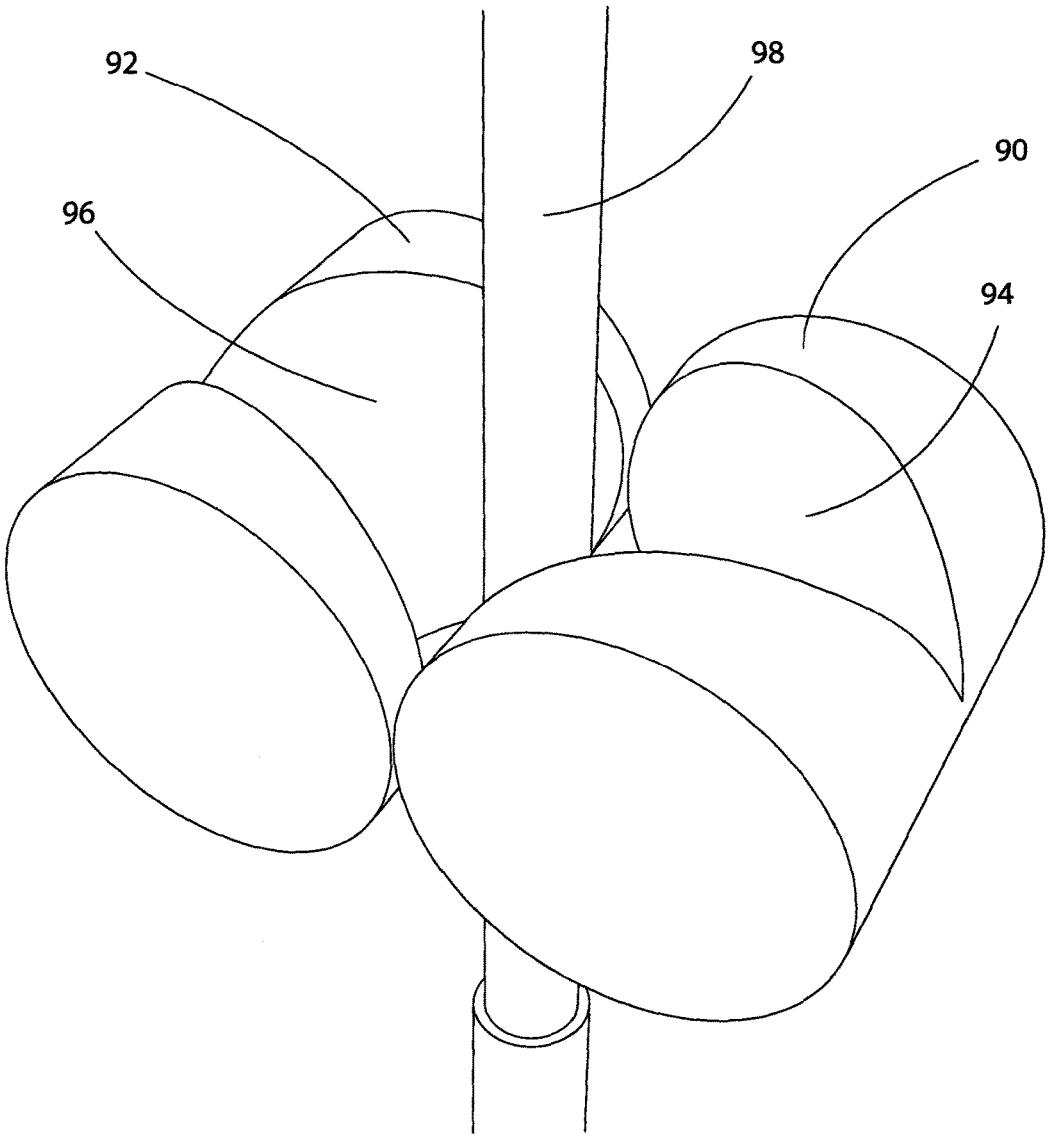
FIG. 5 is a perspective view of a pair of closure elements according to a second embodiment of the present invention.

In other embodiments, the engagement surfaces 56, 58 may be profiled such that the closure elements 30, 32 can seal against tubulars 46 of different diameters. Such an arrangement is shown in FIG. 5, a perspective view of a pair of closure elements 90,92 having profiled engagement surfaces 94,96 for sealing against tubulars 98 of different diameters, according to a second embodiment of the present invention.

Figures 6, 7, 8:
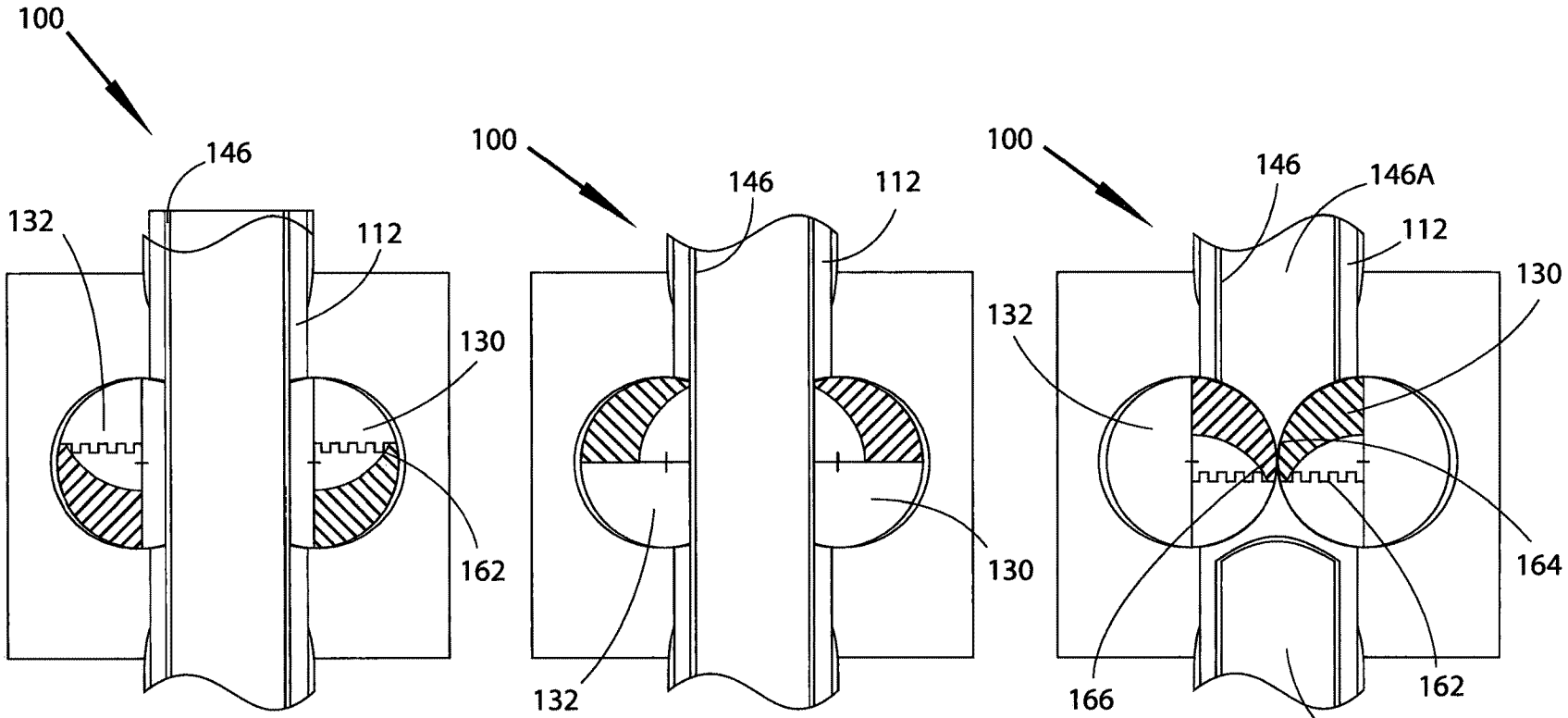
FIG. 6 is a section of an apparatus for fully closing a throughbore shown in the throughbore open position according to a third embodiment of the present invention.
FIG. 7 is a section of the apparatus of FIG. 6 shown in the throughbore partially closed position.
FIG. 8 is a section of the apparatus of FIG. 6 shown in the throughbore fully closed position.

Reference is now made to FIGS. 6, 7 and 8, a section of an apparatus, generally indicated by reference numeral 100, for fully closing a throughbore 112 shown in the throughbore open position (FIG. 6), throughbore partially closed position (FIG. 7) and the throughbore fully closed position (FIG. 8) according to a third embodiment of the present invention.

The operation of the apparatus 100 is largely the same as for the apparatus 10 of the first embodiment. The primary difference is in the arrangement of the closure elements 130, 132. Particularly, each closure element 130, 132 defines a series of teeth 162 adapted to sever the downhole apparatus drill pipe 146. Upon activation, the closure elements are rotated into engagement with the drill pipe 146 (FIG. 7) and then further rotation of the closure elements 130, 132, severs the drill pipe 146 into an upper section 146A and a lower section 146B (FIG. 8). Once the drill pipe lower section 146B has severed, the lower section 146B will drop from the BOP and continued rotation of the closure elements 130, 132 brings a first closure element sealing surface 164 into engagement with a second closure element sealing surface 166 to seal the throughbore 112.

Figure 10:
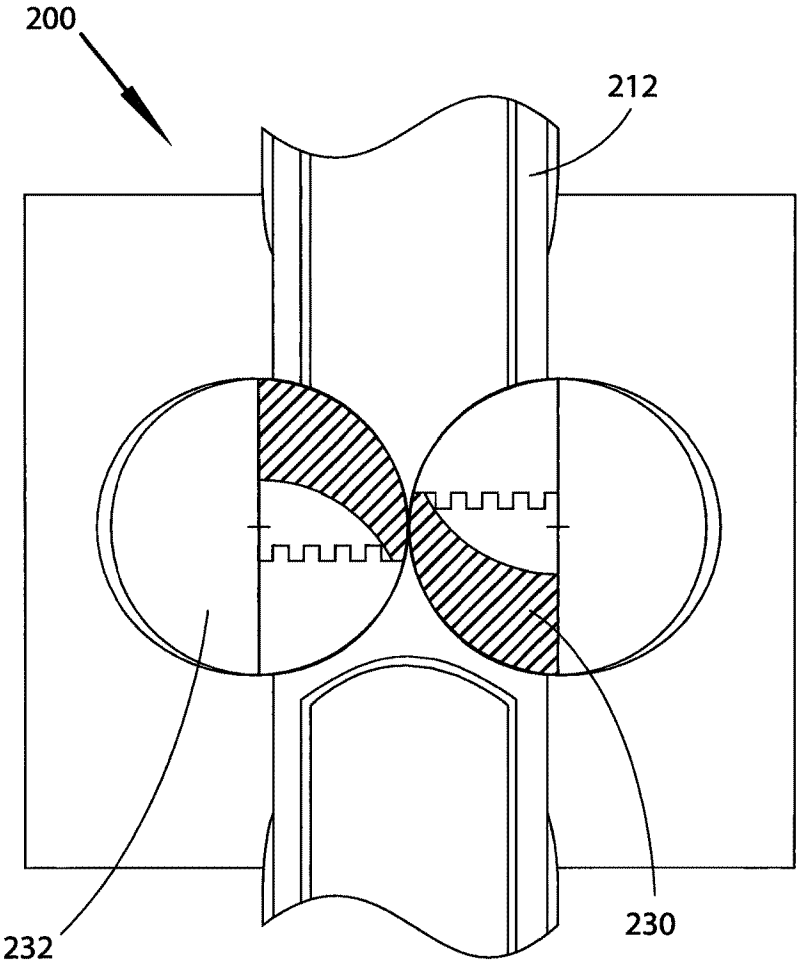
FIG. 10 is a section of the apparatus of FIG. 9 shown in the throughbore fully closed position.
Figure 9:
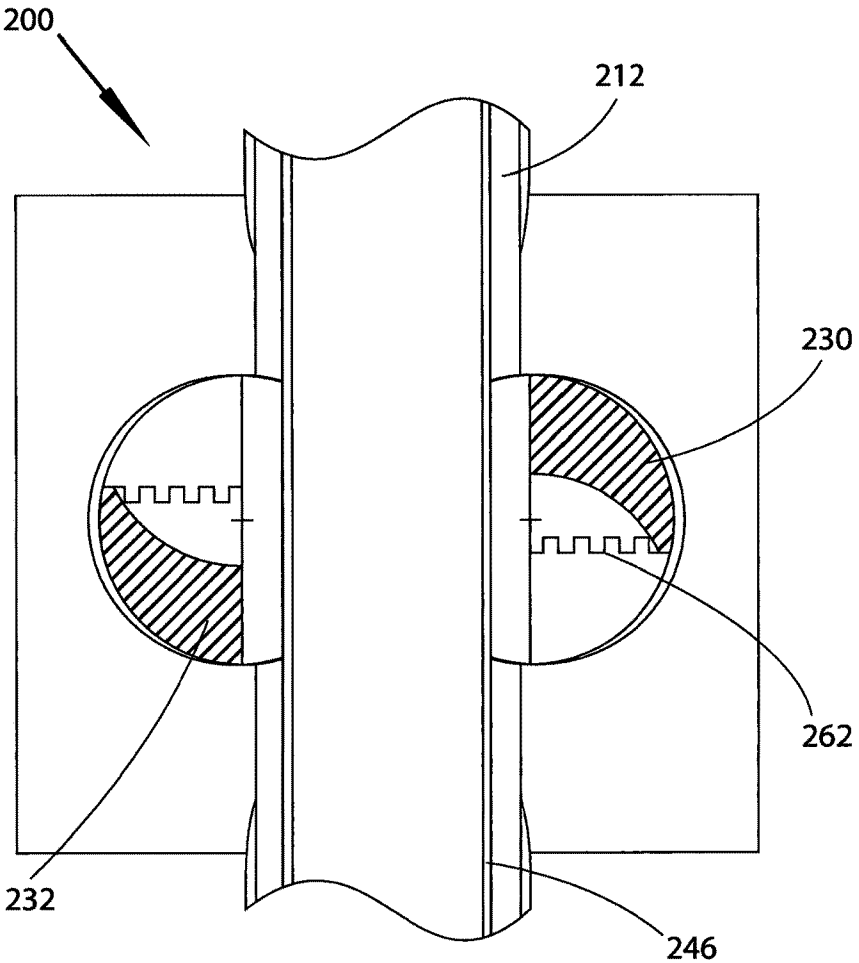
FIG. 9 is a section of an apparatus for fully closing a throughbore shown in the throughbore open position according to a fourth embodiment of the present invention.

A further embodiment of the present invention is shown in FIGS. 9 and 10. These figures show an apparatus 200 for fully closing a throughbore 212 shown in the throughbore open position (FIG. 9) and the throughbore closed position (FIG. 10), according to a fourth embodiment of the present invention.

In this fourth embodiment, the closure elements 230, 232 arranged to rotate in the same direction, that is clockwise, in contrast to the earlier embodiments which rotate in opposite directions. When the downhole apparatus is crushed by the closure elements, the action of the teeth 262 coming towards each other will create a shear force within the drill pipe 246 material, assisting in severance of the drill pipe 246.

Figure 11:
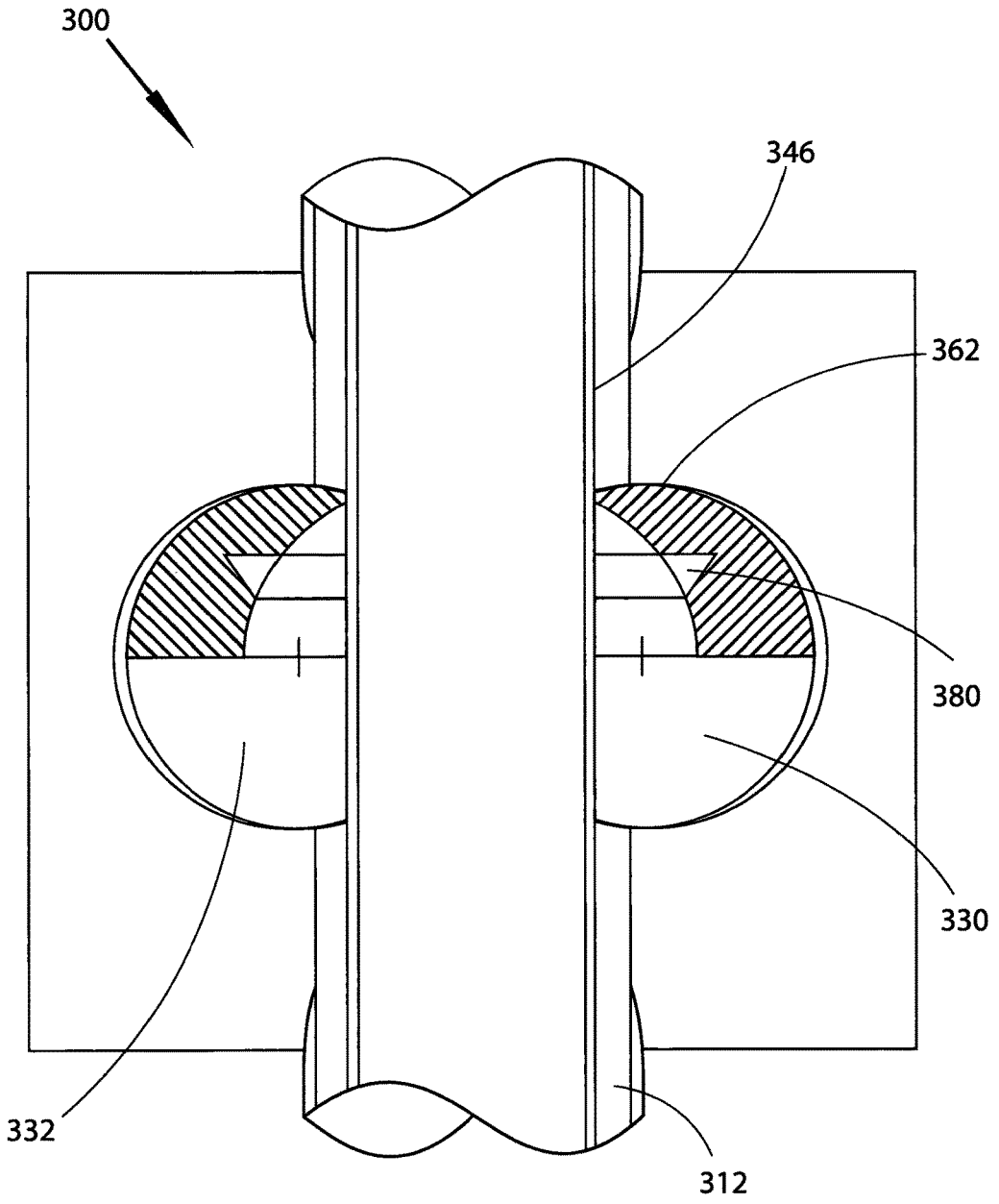
FIG. 11 is a section of an apparatus for severing a downhole apparatus in a throughbore partially closed position according to a fifth embodiment of the present invention.

Reference is now made to FIG. 11, a section of an apparatus 300 for severing a downhole apparatus in a throughbore 312 partially closed position according to a fifth embodiment of the present invention. In this embodiment, similar to the embodiments shown in FIGS. 6 to 8, the closure elements 330, 332 are rotated into the position shown in FIG. 11, however the severing of the drill pipe 346 is achieved not only using teeth 362 but also by firing a linear shaped charge 380.

As the closure elements 330, 332 come into engagement with the drill pipe 346, the charge 380 is detonated, severing or at least weakening the drill pipe 346 sufficiently for the teeth 362 to complete severance of the downhole apparatus drill pipe 346.

Figure 12:
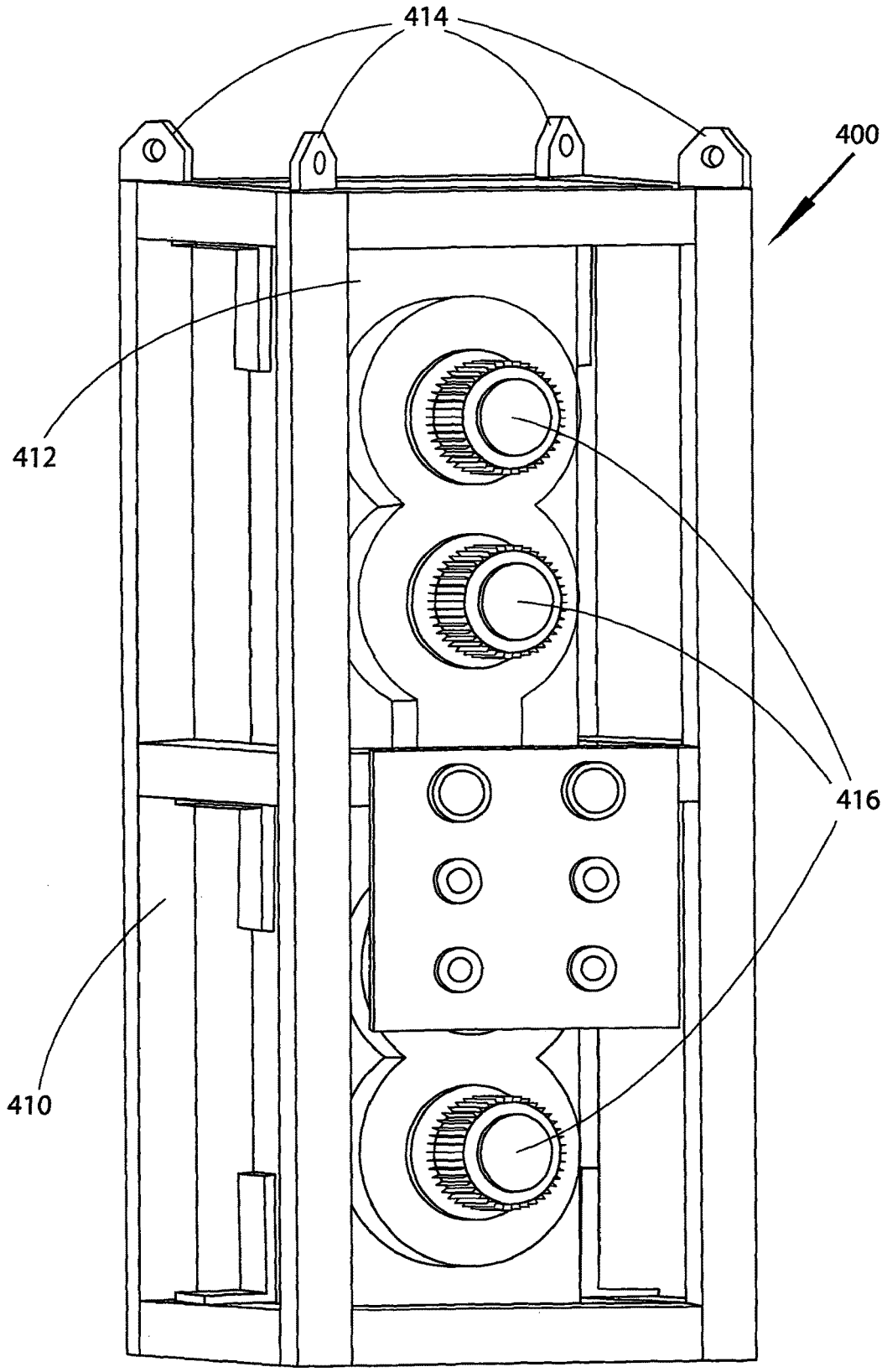
FIG. 12 is an external view of an embodiment of the present invention mounted on a skid.

Reference is now made to FIG. 12, which shows the external view of an apparatus 400 according to an embodiment of the present invention. The apparatus is mounted on a skid 410. The apparatus 400 comprises a housing 412. The skid 410 comprises connecting points in the form of holes 414 in order to facilitate its transport and deployment. The apparatus 400 comprises four pairs of closure elements (not visible, see FIG. 13), each pair adapted to be rotated independently from the others by a motor 416 powering each pair.

Figure 13:
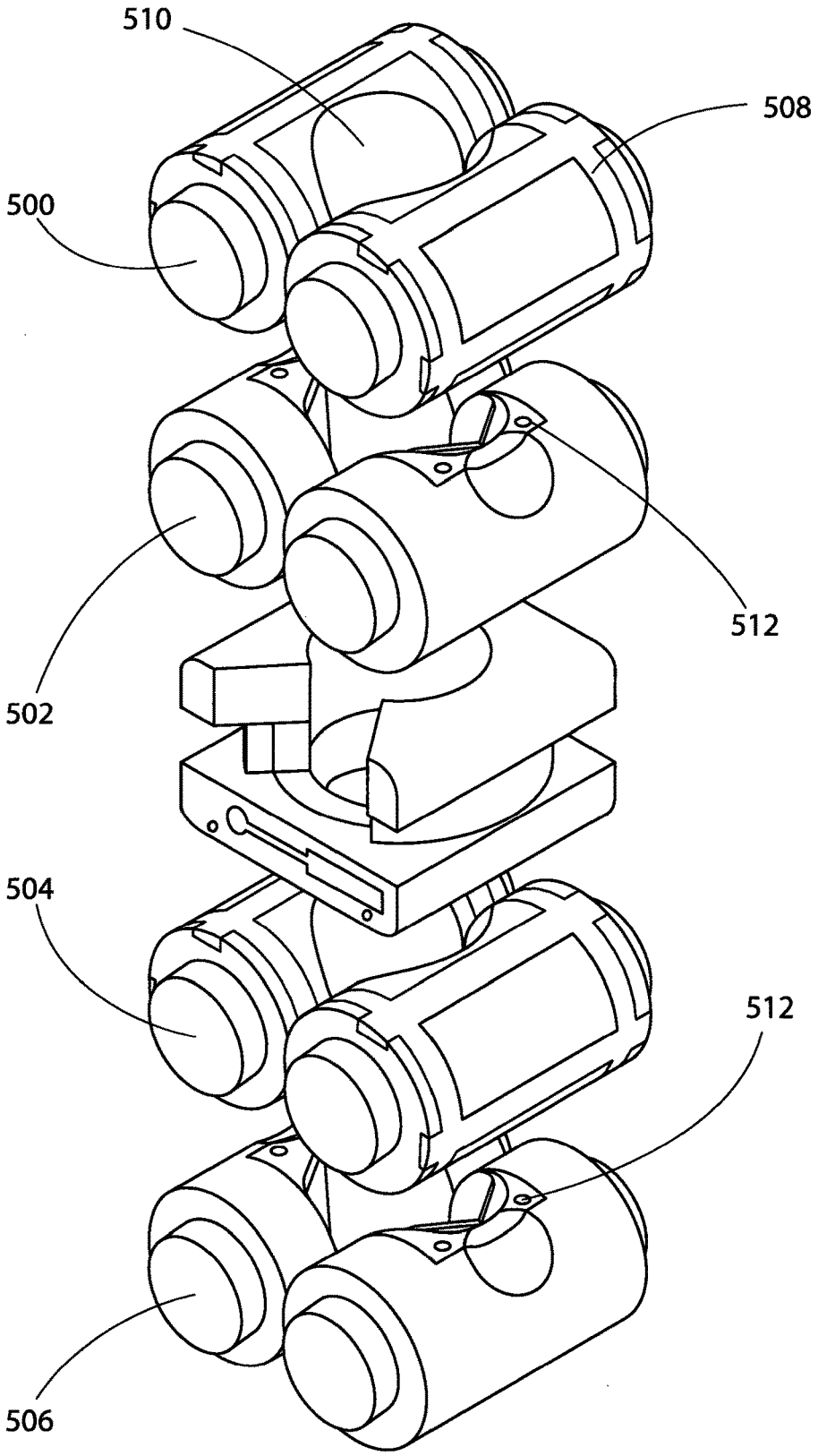
FIG. 13 is a view of the closure elements of the embodiment of FIG. 12.

FIG. 13 shows the internal arrangement of the embodiment shown in FIG. 12. The apparatus 400 comprises four pairs 500, 502, 504, 506 of closure elements in its interior. The apparatus 400 comprises an additional functional element 508 which can be adapted to perform an operation of the user's choice.

The four pairs of closure elements 500, 502, 504, 506 are stacked. Closure element pairs 500 and 504 are adapted to seal the throughbore and comprise portions of resilient material 508 in order to create a complete and tight seal when two portions of resilient material are aligned (one on each closure element) and semicircular recesses 510 so that the throughbore can be opened by the rotation of the closure elements until both semicircular recesses are aligned. Closure element pairs 502 and 506 are adapted to cut or sever a downhole tool that is located in the throughbore. Closure element pairs 502 and 506 comprise recesses for leaving the throughbore opened and other recesses upon which cutting inserts 512 are fitted. The cutting inserts 512 comprise profiled edges adapted to sever a tubular by simultaneous rotation of the closure elements in each pair in an opposite direction.

Figure 14:
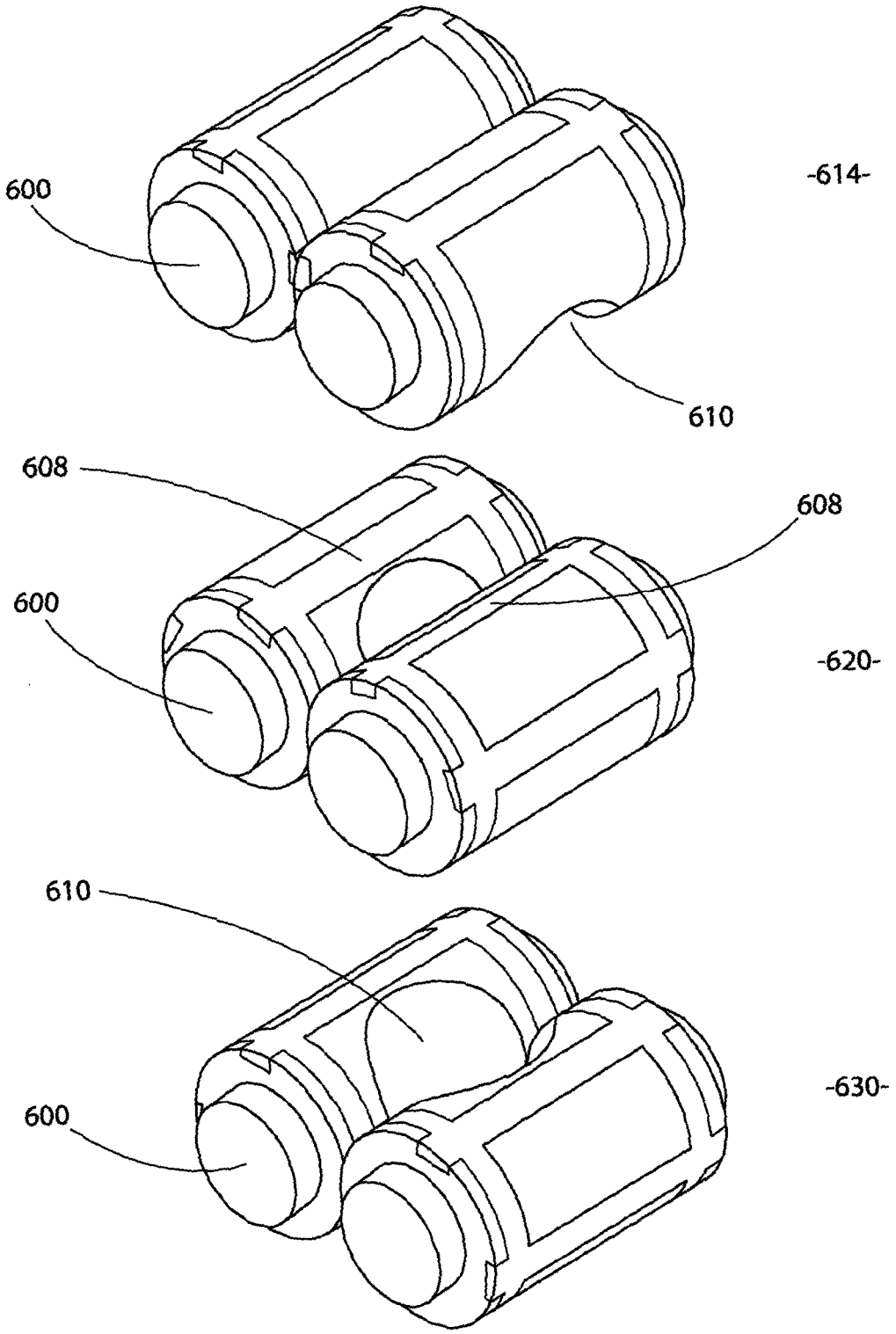
FIG. 14 represents a pair of closure elements, adapted to seal a throughbore, in different positions.

FIG. 14 represents a pair 600 of closure elements adapted to seal a throughbore similar to the pairs 500, 504 of closure elements adapted to seal a throughbore of FIG. 13. Each view of FIG. 14 represents the same pair 600 in different rotational states. First view 614 represents the pair 600 when the closure elements are completely sealing the throughbore, by having two portions of resilient material 608 aligned. Second view 620 represents the pair 600 when the closure elements are partially closing the throughbore by having two semicircular recesses 610 partially aligned. Finally, third view 630 represents the pair 600 of closure elements in fully open position by having the two semicircular recesses 610 completely aligned.

Figure 15:
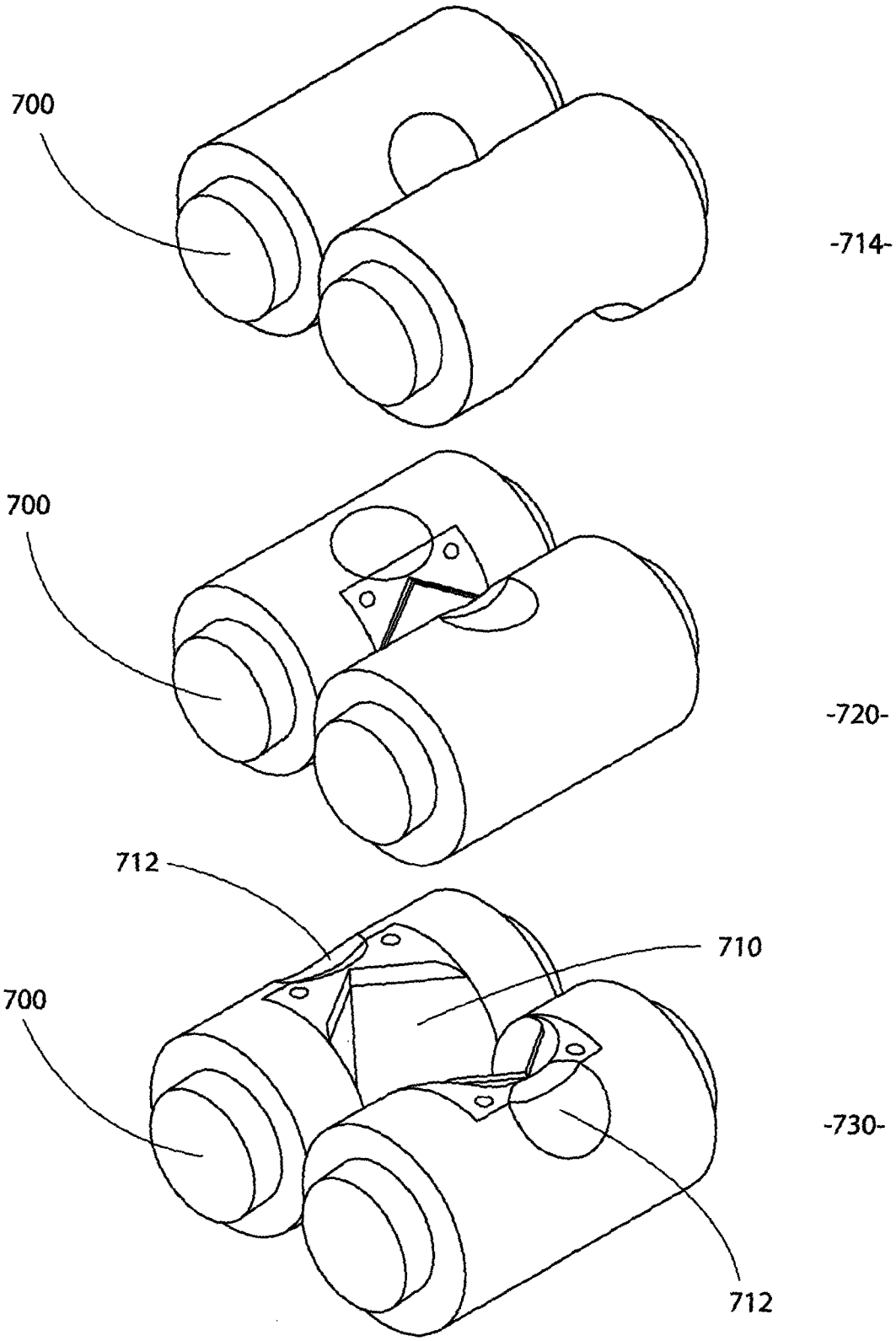
FIG. 15 represents a pair of closure elements, adapted to sever a downhole tool, in different positions.

FIG. 15 represents a pair 700 of closure elements adapted to sever a tubular or downhole tool (not shown) located in a throughbore similar to the pairs 502, 506 of closure elements adapted to sever a tubular or downhole tool located in a throughbore of FIG. 13. Each view of FIG. 15 represents the same pair 700 in different rotational states. First view 714 represents the pair 700 when the closure elements are completely closing the throughbore, by having two cutting inserts (not visible) of resilient material aligned. Second view 720 represents the pair 700 when the cutting inserts 712 are partially closing the throughbore by having two cutting inserts 712 partially aligned. Finally, third view 730 represents the pair 700 of closure elements in fully open position by having the two semicircular recesses 710 completely aligned.

Various modifications and improvements may be made to the above described embodiments without departing from the scope of the invention. For example, although only a pair of closure elements are used in the described embodiments, more than two closure elements could be used in the same plane or a number of pairs or multiples of elements could be used in a stacked arrangement to achieve different levels of closure and to create shear within the drill pipe material.

It also be understood that the purpose of the closure elements may be close around a tubular, for example, in the throughbore.

The invention claimed is:

1. An apparatus for at least partially closing a throughbore, the apparatus comprising:

an apparatus housing, the apparatus housing defining a throughbore, the apparatus housing being configured to receive a downhole tool in the throughbore; and at least one pair of closure elements, wherein each closure element of the at least one pair has multiple engagement surfaces profiled for engaging and sealing against tubulars of different diameters, each closure element of the at least one pair is configured to move between a retracted position, in which the throughbore is fully open, and a first partially deployed position, in which the throughbore is at least partially closed and the apparatus forms a metal to metal seal with the downhole tool located, in use, within the throughbore, each closure element of the at least one pair is configured to further move to a fully deployed position in which the throughbore is closed and sealed, at least a portion of the movement of each closure element between the retracted position and the deployed positions being rotational, the plurality at least one pair of closure elements is configured to centralize the downhole tool within the throughbore in moving to the first partially deployed position, and the apparatus is further configured to cut through the downhole tool when the at least one pair of closure elements move from the first partially deployed position to the fully deployed position.

2. The apparatus according to claim 1, wherein the apparatus is suitable for at least partially sealing the throughbore.

3. The apparatus according to claim 1, wherein the apparatus is a blowout preventer.

4. The apparatus according to claim 1, wherein the apparatus is adapted to seal, in use, against the downhole tool.

5. The apparatus according to claim 1, wherein the apparatus comprises severing means adapted to cut through the downhole tool.

6. The apparatus according to claim 1, wherein an annulus defined by a surface of the throughbore and a first external surface of the downhole tool is closed when a first engagement surface of the multiple engagement surfaces on each closure element of the at least one pair of closure elements engages the downhole tool, on moving to the first partially deployed position.

7. The apparatus according to claim 6, wherein, in use, when engaged with the downhole tool, the closure element first engagement surfaces of each of the at least one pair of closure elements together form a continuous contact surface around the full circumference or perimeter of the downhole tool first external surface.

8. The apparatus according to claim 6, wherein, in use, the closure elements of the at least one pair are adapted, in use, to move from the first deployed position to a second deployed position in which a second engagement surface of the multiple engagement surfaces on each closure element engages a second external surface of the downhole tool such that an annulus defined by a surface of the throughbore and the downhole tool second external surface is closed.

9. The apparatus according to claim 8, wherein, in use, when engaged with the downhole tool second external surface, the closure element second engagement surfaces together form a continuous contact surface around the full circumference or perimeter of the downhole tool second external surface.

10. The apparatus according to claim 8, wherein the closure elements of the at least one pair can move from the retracted configuration to the first deployed configuration whilst the downhole tool is in the throughbore.

11. The apparatus according to claim 1, comprising a pair of closure elements, each closure element of the pair of closure elements rotating about a closure element axis, the closure element axis being fixed with respect to the apparatus housing.

12. The apparatus according to claim 11, wherein each closure element of the pair of closure elements is adapted to rotate about its closure element axis into engagement with a downhole tool located in the apparatus throughbore.

* * * * *